US005697648A

United States Patent [19]

Petkovsek

[11] Patent Number: 5,697,648

[45] Date of Patent: Dec. 16, 1997

[54] INTEGRAL SPECIAL SERVICE MAILING ASSEMBLY AND A METHOD FOR USING SAME

[76] Inventor: Glenn Petkovsek, 20 Tortoise Park Cove, Little Rock, Ark. 72211-2349

[21] Appl. No.: 425,578

[22] Filed: Apr. 20, 1995

[51] Int. Cl.[6] ..... B42D 15/00

[52] U.S. Cl. ..... 283/61; 281/2; 281/5; 462/8; 462/65; 283/81

[58] Field of Search ..... 283/116, 81, 61; 462/6–8, 64, 65; 281/2, 5

[56] References Cited

U.S. PATENT DOCUMENTS 4,418,865 12/1983 Bowen .
4,491,334 1/1985 Dicker .
4,565,317 1/1986 Kranz .
4,682,793 7/1987 Walz .
5,183,203 2/1993 Sanders .
5,190,210 3/1993 Walz .
5,476,420 12/1995 Manning ..... 283/116 X
5,507,526 4/1996 Petkovsek ..... 283/116 X

*Primary Examiner*—Frances Han
*Attorney, Agent, or Firm*—Hill, Steadman & Simpson

[57] ABSTRACT

An assembly for mailing an article requiring special services and a method for mailing same are provided. The assembly includes a single sheet constructed in such a way that one portion of the sheet provides a label and the other portion provides a return postcard or other special service form for attachment to an envelope in its assembled position. The return postcard is integrally formed, but removably attached, such that the return postcard remains attached to the envelope until received by the addressee, at which time the return postcard may be removed.

9 Claims, 6 Drawing Sheets

INTEGRAL SPECIAL SERVICE MAILING ASSEMBLY AND A METHOD FOR USING SAME

BACKGROUND OF THE INVENTION

The present invention generally relates to a form for mailing an article requiring special services. More specifically, the present invention relates to an integral special service mailing assembly for mailing an article requiring special services having a return receipt postcard and a label indicative of the special service and a method for using same.

It is, of course, generally known to mail an article requiring special services for delivery of the article, such as certified mail, registered mail, insured mail, COD, return receipt for merchandise and the like. Known components and methods for assembling a mailer for mailing an article requiring special services have multiple, separate components requiring attachment to an exterior of an envelope for the special services delivery of the article.

For example, when a customer of the U.S. Postal Service desires that an article be mailed by certified mail, for instance, an envelope containing the article is provided to the postal employee by the customer. The postal employee is then required to attach or otherwise provide the envelope with a permanent seal or label indicating that the envelope is to be delivered by certified mail.

Then, a return receipt postcard must be attached to the envelope. The postcard must be completed by the postal employee and/or the customer mailing the envelope containing the article. Some postcards include areas having an adhesive for attaching the postcard to the envelope. Other postcards require separate attachment, by using tape, for example.

Such a procedure is both complex and time-consuming, as well as labor intensive. The procedure requires the postal employee to ensure that all of the appropriate labels and documents are affixed to the envelope prior to delivery of the article. Therefore, the appropriate forms, labels and the like must be adequately stocked and available for the postal employee's use. Further, the postal employee must ensure that all articles are appropriately affixed to the envelope. In addition, the return receipt postcard must be suitably affixed to the envelope so that the return postcard is not removed during the mailing of the article to its destination. Of course, it should be understood that an envelope prepared for special service mailing may be prepared by any individual, not just a postal employee.

A need, therefore, exists for an improved integral special service mailing assembly requiring special services, such as certified mail, insured mail, registered mail, COD, return receipt for merchandise and the like, and a method for using same.

SUMMARY OF THE INVENTION

The present invention provides an assembly and a method for using same for mailing an article requiring special services, such as for certified mail, insured mail, register mail, COD, return receipt for merchandise and the like.

To this end, in an embodiment of the present invention, an assembly for mailing an article requiring special services is provided. The assembly includes a sheet having a first section integrally formed with a second section, the first section including a label indicative of the special service, and the second section including a form, a first anchor portion and a second anchor portion located at opposite ends of the form, the form independently detachable from the anchor portions and the label.

In an embodiment, the special service mailing assembly further has a line of separation formed between the form and the label, the line of separation constructed and arranged to provide independent removal of the form.

In an embodiment, the special service mailing has a first tear line formed between the first anchor portion and the form, and a second tear line formed between the second anchor portion and the form, the first tear line and the second tear line constructed and arranged to provide independent detachment of the form.

In an embodiment, the form of the special service mailing assembly is a return receipt postcard.

In an embodiment, the label of the special service mailing assembly is a certified mail label.

In an embodiment, the adhesive portion of the special service mailing assembly is a peel-and-stick adhesive portion.

In an embodiment, the sheet of the special service mailing assembly includes printer feed holes located along opposite sides of the sheet.

In an embodiment, the special service mailing assembly has at least one identifier section having an identifier related to the special service label removably attached to the sheet.

In an embodiment, the label of the special service mailing assembly has an adhesive portion.

In an embodiment, the form of the special service mailing assembly has a first adhesive portion located on the first anchor portion and a second adhesive portion located on the second anchor portion.

In an embodiment, the label of the special service mailing assembly has at least one identifier section having an identifier related to the special service label removably attached to at least one of the anchor portions.

In another embodiment of the present invention, a special service mailing assembly is provided having a sheet, and a plurality of special service forms removably attached to the sheet, the plurality of special service forms integrally formed on the sheet and capable of independent detachment from the sheet.

In an embodiment, the sheet of the special service mailing assembly may have printer feed holes located along opposite sides of the sheet.

In an embodiment, the plurality of special service forms of the special service mailing assembly are return receipt postcards.

In an embodiment, the plurality of special service forms of the special service mailing assembly are return receipt postcards in combination with special service labels.

In an embodiment, the special service mailing assembly includes a tear line formed in the length thereof to provide independent detachment of the plurality of special service forms from one another.

In an embodiment, the special service mailing assembly includes a form having a first anchor portion with a tracking indicator and a second anchor portion, the form removably attached to the first and second anchor portions, and a label indicative of the special service removably attached to one of the anchor portions of the form.

In another embodiment of the present invention, a method is provided for mailing an article requiring a special service, the article having a front side and a back side. The method has the steps of providing a sheet having a first section integrally formed with a second section, the first section including a label indicative of the special service, and the second section including a form, a first anchor portion and a second anchor portion located at opposite sides of the form, the form being independently detachable from the anchor portions and the label; attaching the label to the front side of the article; and attaching the first anchor portion and the second anchor portion to the back side of the article.

In an embodiment, the method further comprises the steps of providing an adhesive portion on the label; and providing a first adhesive portion located on the first anchor portion and a second adhesive portion located on the second anchor portion.

In an embodiment, the method further comprises the steps of providing a peel-and-stick adhesive portion on the label; and providing a first peel-and-stick adhesive portion on the first anchor portion and a second peel-and-stick adhesive portion on the second anchor portion.

It is, therefore, an advantage of the present invention to provide an improved assembly for mailing an article requiring special services.

Another advantage of the present invention is to provide a simplified method for mailing an article requiring special services.

And, another advantage of the present invention is to provide an assembly that is integrally formed as a complete unit for mailing and labeling of an article requiring special services.

Yet another advantage of the present invention is to provide an assembly and a method for mailing an article requiring special services without requiring additional adhesives or fixatives for attaching the same to the mailpiece.

Moreover, an advantage of the present invention is to provide an assembly and a method for mailing an article requiring special services that is substantially foolproof.

Yet a further advantage of the present invention is to provide an assembly which will work on automated printing equipment.

And, another advantage of the present invention is to provide an assembly including a label and a form that provides for pre-imaging or pre-printing of variable information thereon.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention provides an integral special service mailing assembly for mailing an article requiring special services. Further, the present invention provides a method for using the assembly for mailing articles requiring special services.

Figure 1:
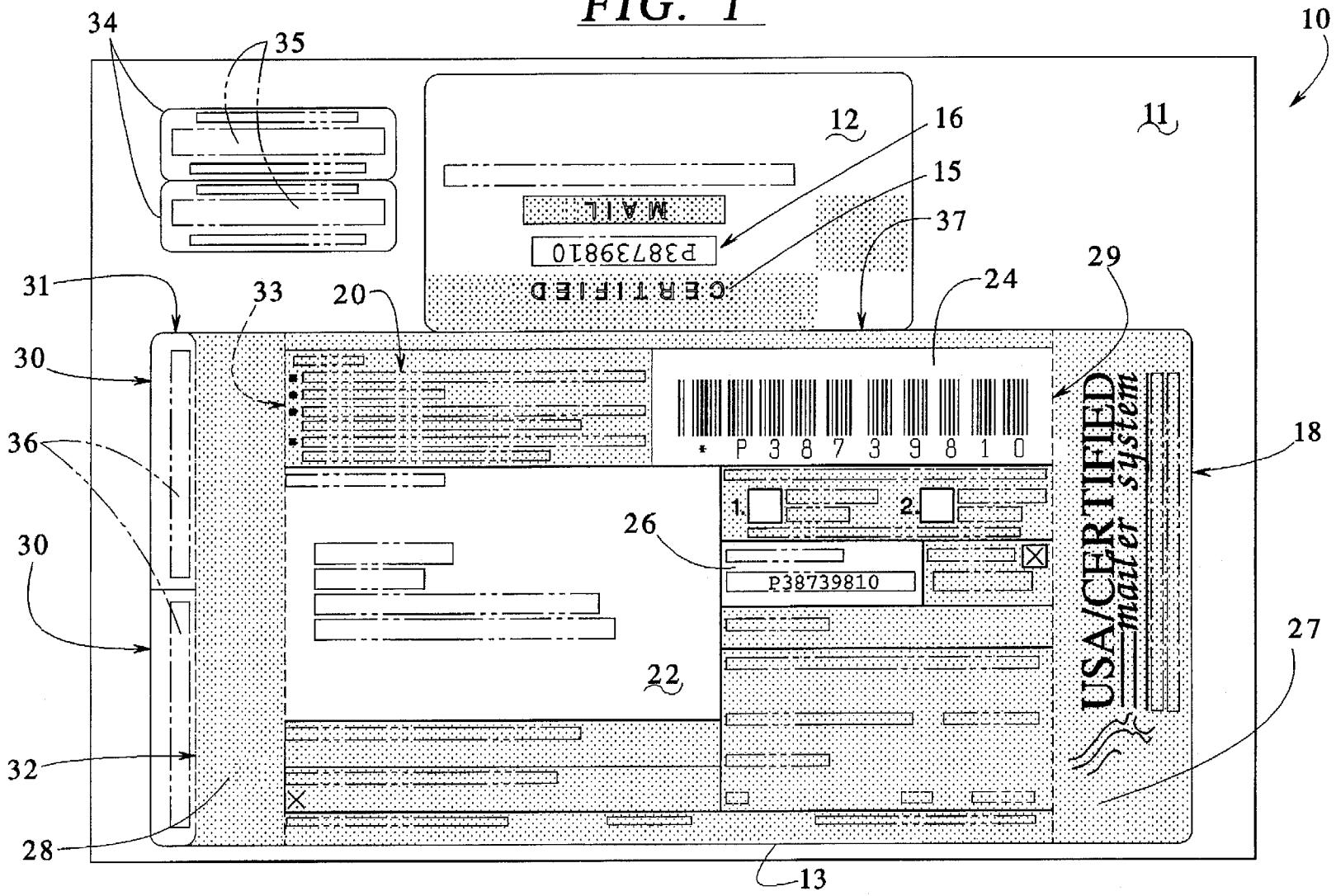
FIG. 1 illustrates a plan view of a front side of an embodiment of an assembly of the present invention.
Figure 4:
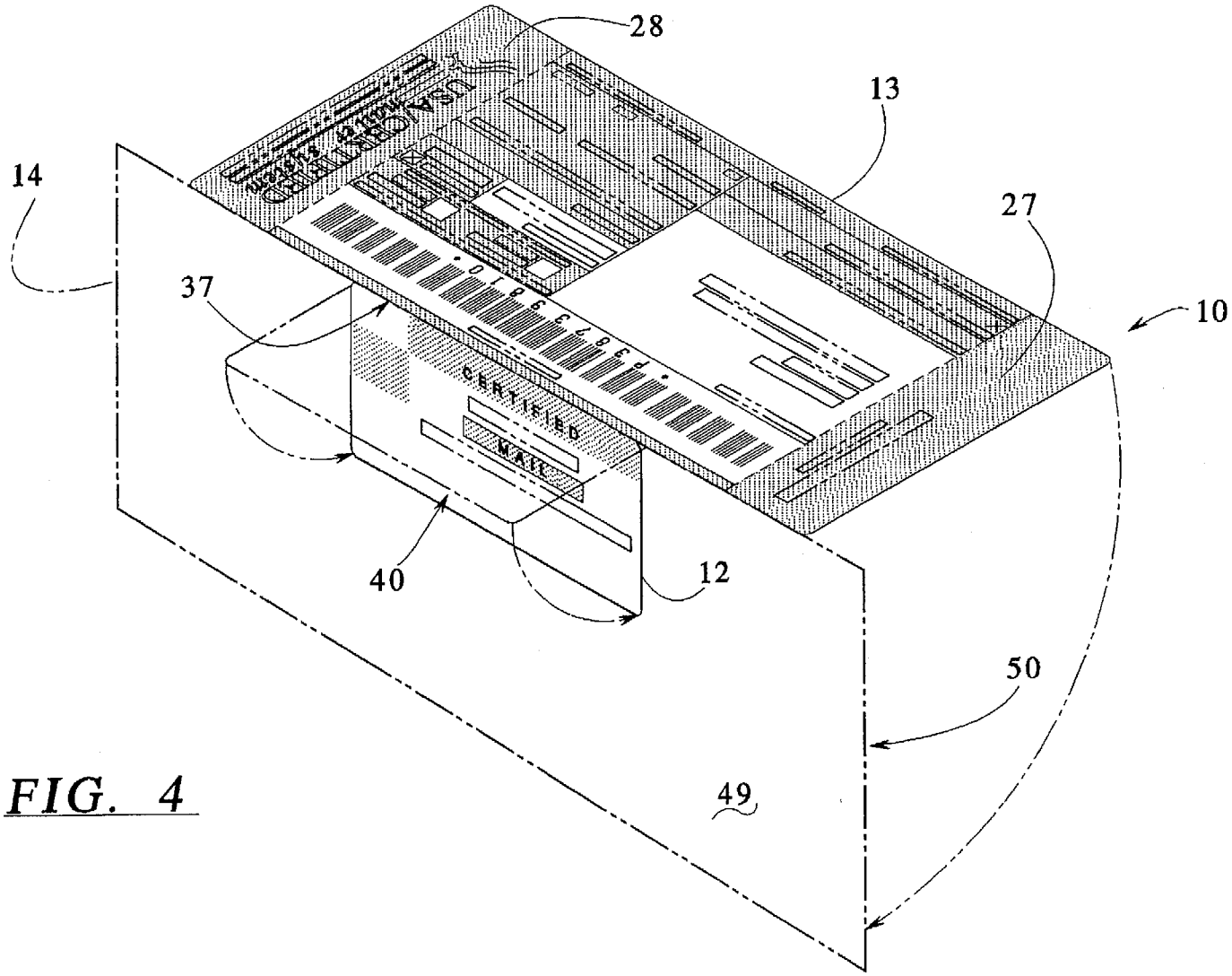
FIG. 4 illustrates a perspective view of a front side of an embodiment of the assembly of the present invention with an article to be mailed using same.

Referring now to the drawings, wherein like numerals refer to like parts, FIG. 1 is a front plan view that generally illustrates an embodiment of an assembly 10 formed from a single sheet 11 to provide both a label 12 and a return postcard 13. The assembly 10 is capable for use in mailing an article 14 requiring a special service, such as shown in FIG. 4. Although a certified mail envelope is illustrated, it should be understood that the present invention is applicable to any mailing item requiring special services, such as insured mail, registered mail, COD, return receipt for merchandise and the like.

The front side of the embodiment of the assembly 10 illustrated in FIG. 1 includes the label 12. The label 12 is, in a preferred embodiment, a pre-printed label indicative of the special service required for mailing of the article 14. The label 12 is preferably pre- printed directly on the sheet 11. The pre-printed label 12 includes a special service indicator 15 and a window section 16 in which an article identification number can be printed.

The assembly 10 also has a front bottom portion 18 that includes the return receipt postcard 23 that can be similar to United States Postal Service form PS-3811. The return receipt postcard 13 may include a set of instructions 20 for the sender, as well as an article addressee section 22 for pre-printing the addressee's address. The return receipt postcard 13 also has a document control number bar code 24 to aid in tracking of the article 14.

In addition, the return receipt postcard 13 has a number of sub-sections requiring completion by the sender prior to mailing. One sub-section illustrated at numeral 26 includes a machine readable article identification number corresponding to the number in the window section 16 of the pre-printed label 12. The sub-section 26 may have a background color that contrasts with the color of the return receipt postcard 13 so as to simplify the reading of the machine-readable code in the sub-section 26. Other sections, as well, may include similar color-contrasting portions within the return receipt postcard 13.

Another section of the bottom portion 18 of the assembly 10 is, in a preferred embodiment, a first anchor portion 27 at one end of the return receipt postcard 13 and a second anchor portion 28 at the opposite end. The first anchor portion 27 is separable from the return receipt postcard 13 by means of a perforated tear line 29.

The second anchor portion 28 may include at least one article tracking label 30 provided along a detachable strip 31 at the opposite end of the bottom portion 18 of the assembly 10 and is removable from the bottom portion 18 by a perforated tear line 32. The second anchor portion 28 is also separable from the return receipt postcard 13 by tearing along a perforated tear line 33.

The article tracking label 30 may be adhesively backed for subsequent attachment to a receipt or other item requiring designation of the article number for related purposes. As illustrated, two tracking labels 30 are provided in the embodiment shown. For example, one of the tracking labels 30 may be used by a postal delivery employee on a postal form PS-3849, a delivery notice, (not shown). The second tracking label 30 may be used for the receiver's record use.

In addition, in the embodiment shown, two additional tracking labels 34 are provided. The two additional tracking labels 34, which also include a section 35 for the article identification number, may be used for the sender's records.

The certified article number tracking labels 30 can also be used for the sender's and receiver's record keeping and/or accounting use. Each tracking label 30 has a section 36 for the article identification number. The tracking label 30 may be provided with adhesive on its reverse side. The tracking label 30 may also be a peel-and-stick type label.

Thus, the bottom portion 18 of the assembly 10 includes three main sections: the return receipt postcard 13 and the first and second anchor portions 27, 28. In addition, the tracking labels 30, 34 are provided. The label 12 may be separated from the return receipt postcard 13 by a score line 37 to facilitate separation of the postcard 13 upon delivery of the article 14. As mentioned above, the return receipt postcard 13 has a number of sub-sections requiring completion by the sender prior to mailing of the article 14. After delivery of the article 14, the return receipt postcard 13 is detachable from the first and second anchor portions 27, 28 by tearing along the perforated tear lines 29,33, respectively.

An advantage of the present invention is that a number of the sub-sections of the return postcard 13 and the label 12 discussed above can be pre-printed when the assembly 10 of the present invention is used.

Figure 2:
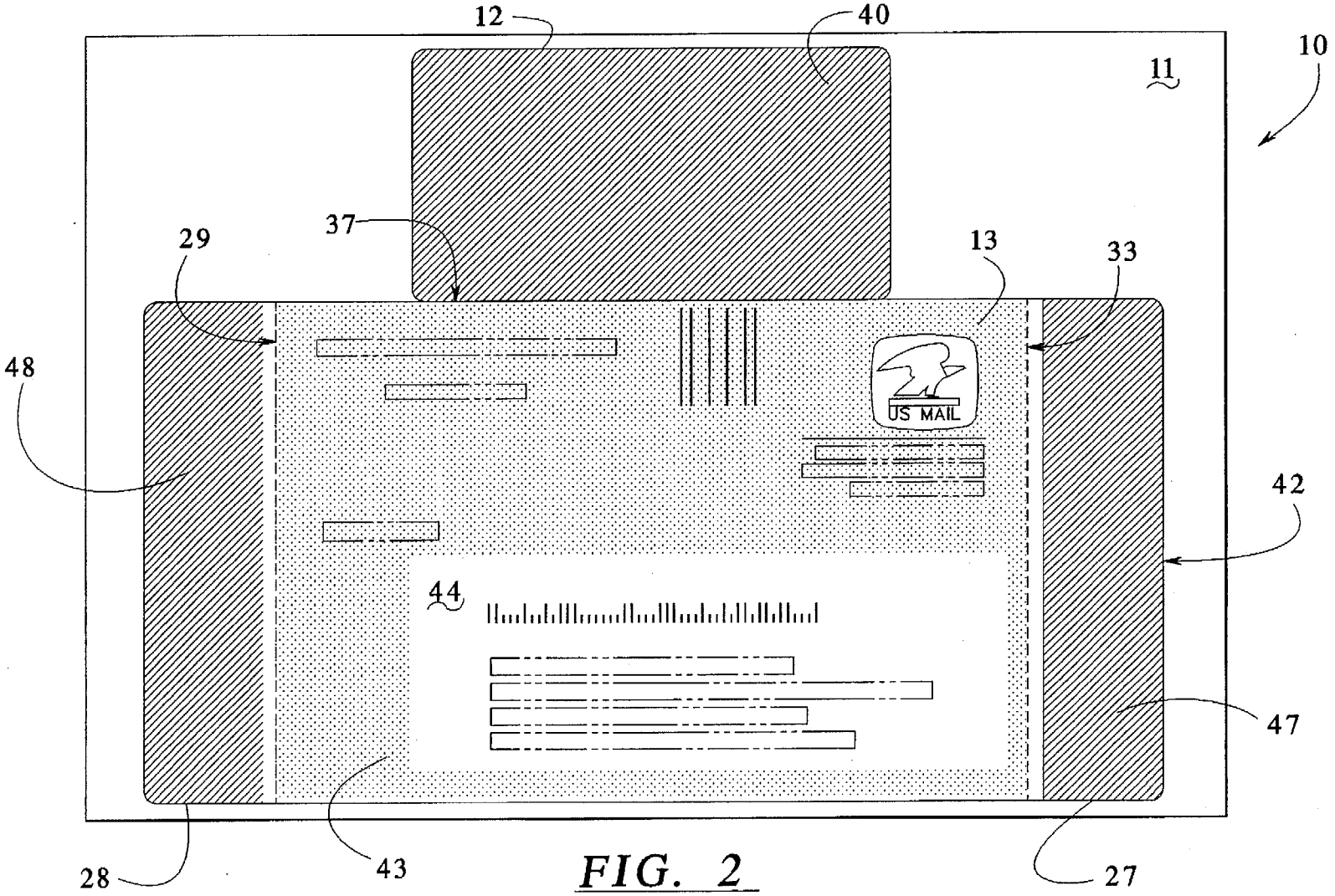
FIG. 2 illustrates a plan view of a back side of an embodiment of the assembly of the present invention.

Referring now to FIG. 2, a back plan view of an embodiment of the assembly 10 is illustrated. The reverse side of the label 12 shown in FIG. 1 has an adhesive portion 40. The adhesive portion 40 may be a peel-and-stick type adhesive and is provided to seal the label 12 to the article 14 requiring special service mailing as shown in FIG. 4.

A back bottom portion 42 of the assembly 10 includes a front side 43 of the return receipt postcard 13. The return receipt postcard 13 includes a "Return To" section 44. The "Return To" section 44 may be color-contrasted with the remainder of the return receipt postcard 13 to enable simplified reading of the "Return To" section 44.

The score line 37 is provided along the top side of the return receipt postcard 13. For subsequent detachment of the return receipt postcard 13, the perforated tear lines 29, 33 are provided along the edges adjacent to the anchor portions 27, 28. The first anchor portion 27 has a first adhesive portion 47 and the second anchor portion 28 has a second adhesive portion 48 to adhere the back bottom portion 42 to the article 14 prior to mailing.

Figure 3:
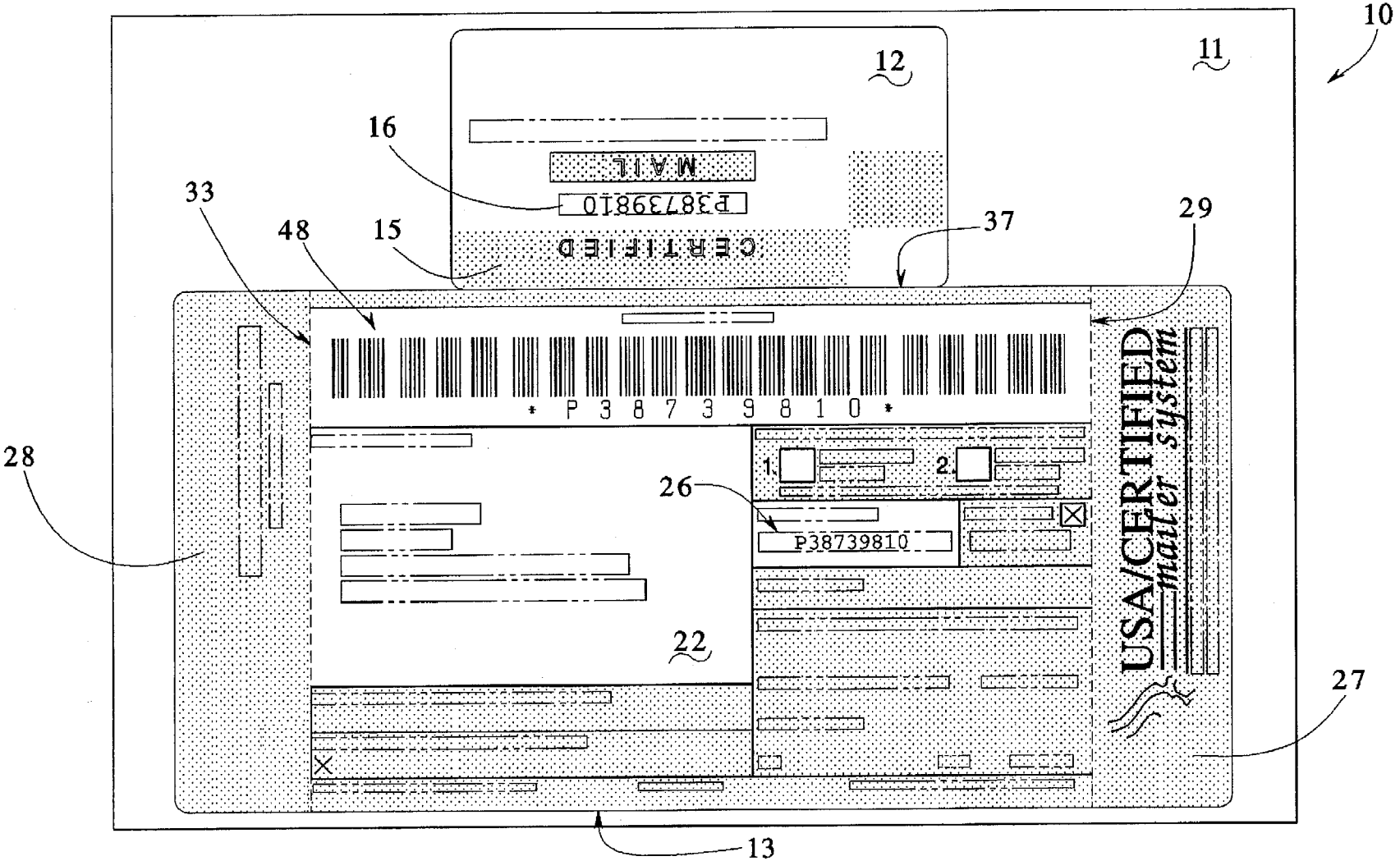
FIG. 3 illustrates a plan view of a front side of another embodiment of the assembly of the present invention.

FIG. 3 shows another embodiment of the assembly 10 of the present invention, wherein like numerals represent like parts. This embodiment is a simplified version of the prior embodiment in that it does not have the instruction section 20 nor does it have the tracking labels 30, 34. However, the embodiment illustrated in FIG. 3 has an enlarged bar code region 48 for easier reading during high speed processing. The embodiment of the present invention illustrated in FIG. 3 is shown in use in FIG. 4.

Referring now to FIG. 4, the article 14 requiring special service, shown from its front side, is shown. The pre-printed label 12 is shown having the window section 16 in which the certified mail number is printed either manually or automatically. As illustrated, the label 12 folds down onto a front side 49 of the article 14 requiring special service mailing. The label 12 is adhered to the front side 49 of the article 14 by means of the adhesive portion 40 located on the back side of the label 12 (see FIG. 2).

Also as illustrated in FIG. 4, the bottom portion 18 of the assembly 10, including the anchor portions 27, 28 and the return receipt postcard 13, is sealed to a back side 50 of the article 14, and the anchor portions 27, 28 are sealed to the article 14 by the adhesive portions 47 and 48, respectively. Also, the score line 37 is located at the top of the article 14 to provide for easier subsequent separation of the return receipt postcard 13 from the anchor portions 27, 28 and the label 12 upon delivery of the article 14.

Figure 5:
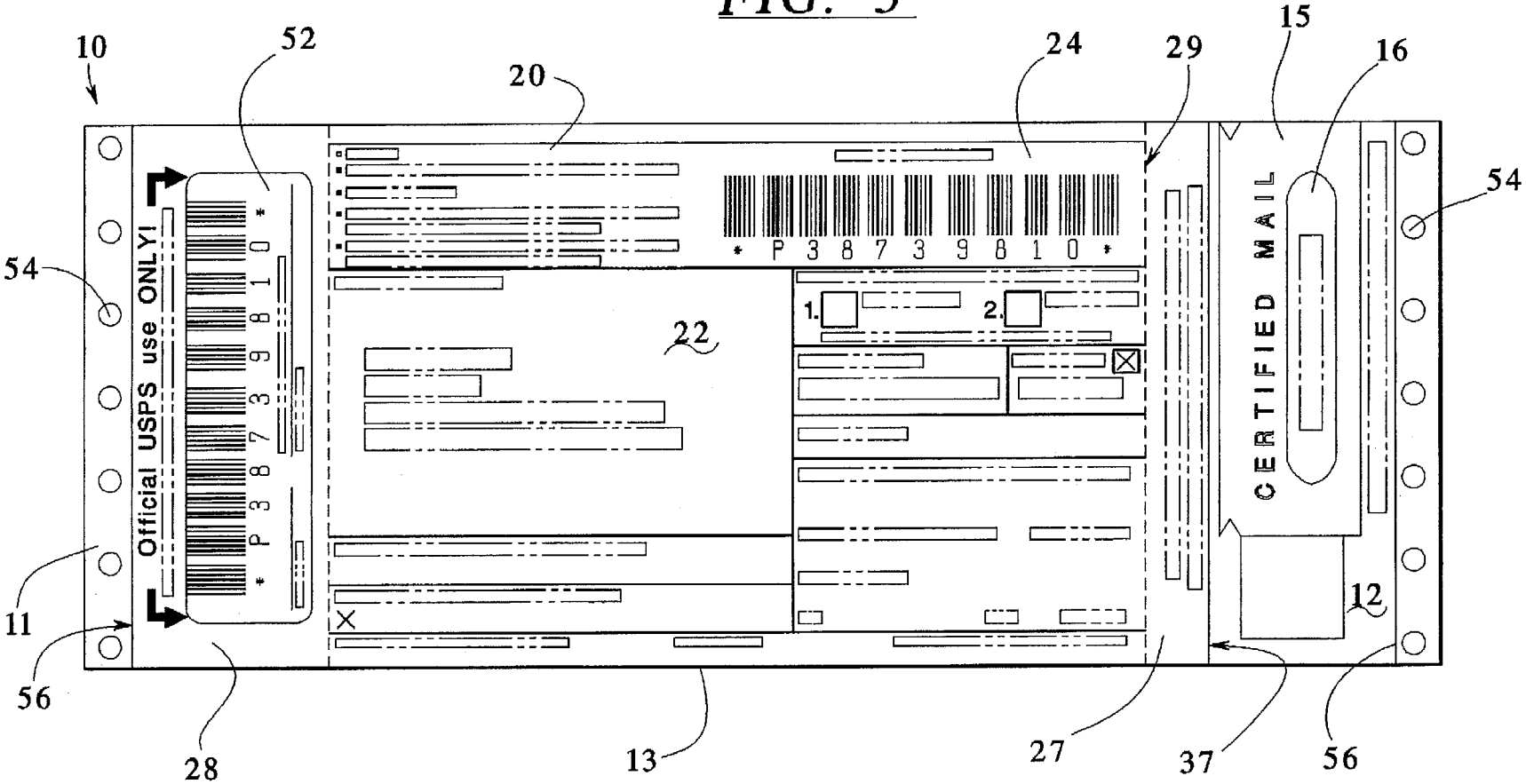
FIG. 5 illustrates a plan view of a front side of another embodiment of the assembly of the present invention.

FIG. 5 illustrates another embodiment of the assembly 10 of the present invention in which like numerals represent like parts. In the embodiment shown in FIG. 5, an alternate orientation of the label 12 with respect to the postcard 13 is shown. For example, the score line 37 is located between the label 12 and the return receipt postcard 13 to allow separation of the label 12 from the postcard 13. In addition, a tracking indicator 52 is provided on the second anchor portion 28.

Another variation in the embodiment shown in FIG. 5 is that the sheet 11 has a plurality of tracker holes 54 on the edges thereof for use in a printer (not shown) having tracking wheels to advance the paper. The tracking holes 54 are located on a tracking strip 56.

Figure 6:
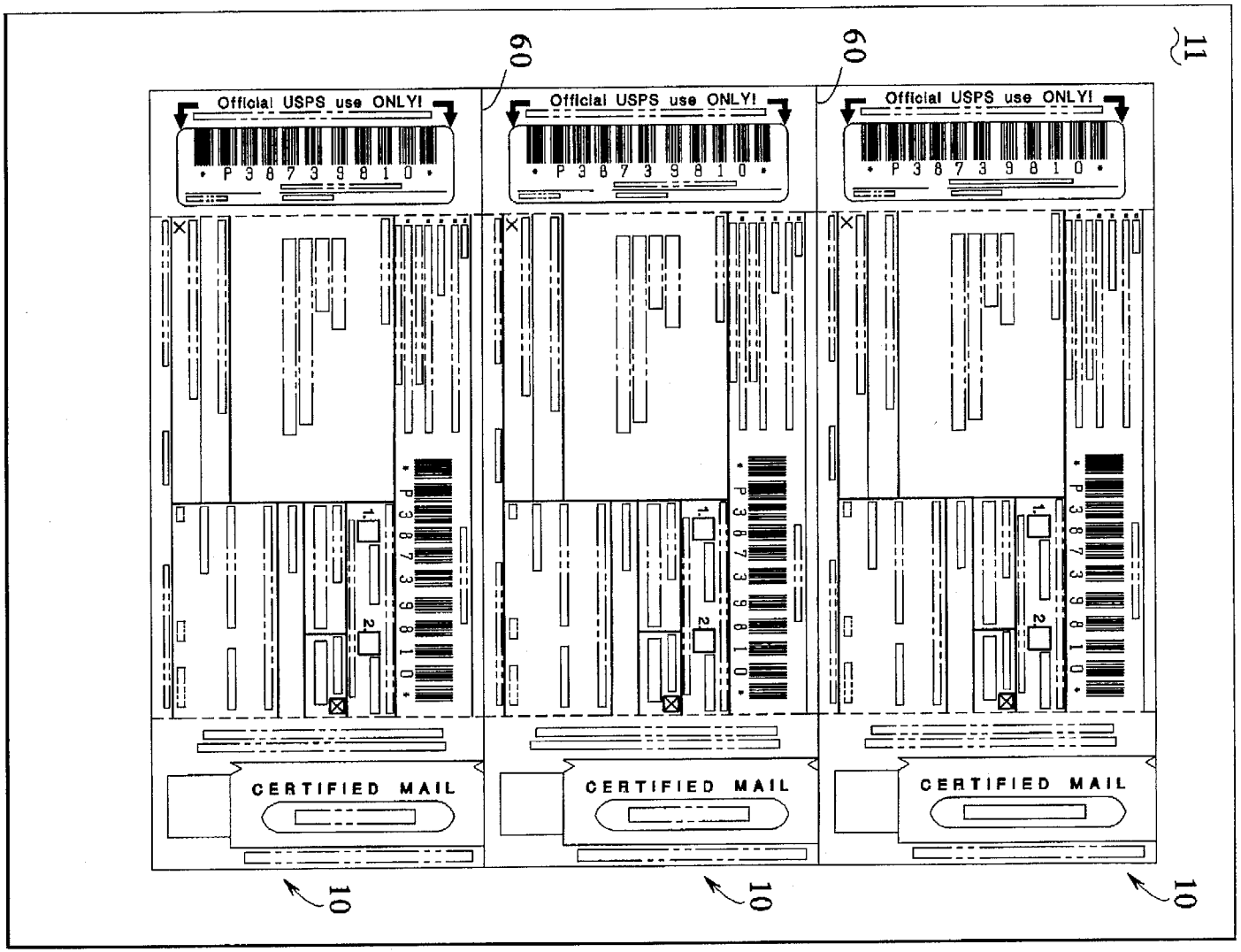
FIG. 6 illustrates a plan view of yet another embodiment of the assembly of the present invention in which a plurality of assemblies are located on a single sheet.

In addition, a plurality of the assembly 10 can be provided on the single sheet 11 as shown in FIG. 6. Each assembly 10 is separable from the adjacent assembly 10. This can be accomplished by a score line 60. In such a case, it is preferred that the assembly 10 be a peel-and-stick type assembly that is removably attached to the sheet 11. Thus, each individual assembly 10 is detachable from the sheet 11 as needed. Also, the entire sheet can be printed at one time for subsequent separation and application to separate articles 14.

The assembly 10 can be printed using any known method of printing and is not limited to any single type. Such printing methods include, but are not limited to, laser printing, thermal printing, dot matrix printing and the like. Printing may be performed on continuously fed forms or on individually fed forms.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A special service mailing assembly for mailing an article requiring a special service, the assembly comprising:

a first sheet;

a second sheet directly attached to the first sheet, having a first section integrally formed with a second section, the first section including a label having an adhesive back side indicative of the special service, and the second section including a form, a first anchor portion having an adhesive back side and a second anchor portion having an adhesive back side wherein the anchor portions are located at opposite ends of the form, the form being independently detachable from the anchor portions and the label and further wherein the second sheet is removably attached to the first sheet by the adhesive back sides of the label, the first anchor portion and the second anchor portion.

2. The special service mailing assembly of claim 1 further comprising:

a line of separation formed between the form and the label, the line of separation constructed and arranged to provide independent removal of the form.

3. The special service mailing assembly of claim 1 further comprising:

a first tear line formed between the first anchor portion and the form; and a second tear line formed between the second anchor portion and the form, the first tear line and the second tear line constructed and arranged to provide independent detachment of the form.

4. The special service mailing assembly of claim 1 wherein the form is a return receipt postcard.

5. The special service mailing assembly of claim 1 wherein the label is a certified mail label.

6. The special service mailing assembly of claim 1 wherein the first sheet includes printer feed holes located along opposite sides of the first sheet.

7. The special service mailing assembly of claim 1 further comprising:

at least one identifier section having an identifier related to the special service label removably attached to the first sheet.

8. The special service mailing assembly of claim 1 further comprising:

at least one identifier section having an identifier related to the special service label removably attached to at least one of the anchor portions.

9. A method for mailing an article requiring a special service, the article having a front side and a back side, the method comprising the steps of:

providing a first sheet;

providing a second sheet directly attached to the first sheet having a first section integrally formed with a second section, the first section including a label having an adhesive back side indicative of the special service, and the second section including a form, a first anchor portion having an adhesive back side and a second anchor portion having an adhesive back side wherein the first anchor portion and the second anchor portion are located at opposite sides of the form, the form being independently detachable from the anchor portions and the label wherein the second sheet is removably attached to the first sheet by the adhesive back sides of the label, the first anchor portion and the second anchor portion;

removing the second sheet from the first sheet;

attaching the label to the front side of the article; and attaching the first anchor portion and the second anchor portion to the back side of the article.

* * * * *